US009920656B2

(12) United States Patent
Landwehr et al.

(10) Patent No.: US 9,920,656 B2
(45) Date of Patent: Mar. 20, 2018

(54) COATING FOR ISOLATING METALLIC COMPONENTS FROM COMPOSITE COMPONENTS

(71) Applicant: Rolls-Royce Corporation, Indianapolis, IN (US)

(72) Inventors: Sean E. Landwehr, Avon, IN (US); Sungbo Shim, Zionsville, IN (US); Adam L. Chamberlain, Mooresville, IN (US); Ann Bolcavage, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 295 days.

(21) Appl. No.: 14/749,296

(22) Filed: Jun. 24, 2015

(65) Prior Publication Data

US 2015/0377069 A1 Dec. 31, 2015

Related U.S. Application Data

(60) Provisional application No. 62/018,712, filed on Jun. 30, 2014.

(51) Int. Cl.

| | |
|---|---|
| ***F01D 25/24*** | (2006.01) |
| ***F01D 25/28*** | (2006.01) |
| *F01D 11/08* | (2006.01) |

(52) U.S. Cl.

CPC ..... *F01D 25/28* (2013.01); *F01D 25/246* (2013.01); *F01D 11/08* (2013.01); *F05D 2220/32* (2013.01); *F05D 2230/40* (2013.01); *F05D 2230/60* (2013.01); *F05D 2230/90* (2013.01); *F05D 2240/11* (2013.01); *F05D 2240/80* (2013.01); *F05D 2240/90* (2013.01); *F05D 2300/13* (2013.01); *F05D 2300/131* (2013.01); *F05D 2300/2112* (2013.01);

(Continued)

(58) Field of Classification Search

None

See application file for complete search history.

(56) References Cited

U.S. PATENT DOCUMENTS

| | | | |
|---|---|---|---|
| 4,975,314 | A | 12/1990 | Yano et al. |
| 5,167,988 | A | 12/1992 | Yano et al. |
| 5,200,241 | A | 4/1993 | Nied et al. |

(Continued)

FOREIGN PATENT DOCUMENTS

| | | |
|---|---|---|
| EP | 1063213 A1 | 9/2003 |
| EP | 1693478 A2 | 8/2006 |

(Continued)

OTHER PUBLICATIONS

European Search Report Application No. EP15172924, completed Nov. 10, 2015, (6 pages).

(Continued)

*Primary Examiner* — Dwayne J White
*Assistant Examiner* — Theodore Ribadeneyra
(74) *Attorney, Agent, or Firm* — Shumaker & Sieffert, P.A.

(57) ABSTRACT

A barrier coating for isolating a metallic support component from a composite component in a gas turbine engine is provided. The barrier coating may be applied to the metallic support component so that when the ceramic component is mounted on the metallic support component the barrier coating is engaged.

20 Claims, 5 Drawing Sheets

(52) U.S. Cl.
CPC .. *F05D 2300/222* (2013.01); *F05D 2300/611* (2013.01); *F05D 2300/701* (2013.01)

(56) References Cited

U.S. PATENT DOCUMENTS

| | | | | |
|---|---|---|---|---|
| 5,776,620 | A | 7/1998 | Josso et al. | |
| 6,335,105 | B1 | 1/2002 | McKee | |
| 6,758,386 | B2 | 7/2004 | Marshall et al. | |
| 6,758,653 | B2 * | 7/2004 | Morrison | F01D 9/04 415/116 |
| 6,893,750 | B2 | 5/2005 | Nagaraj et al. | |
| 6,932,566 | B2 * | 8/2005 | Suzumura | F01D 11/08 415/135 |
| 7,857,194 | B2 | 12/2010 | Kramer | |
| 8,475,945 | B2 | 7/2013 | Schmidt et al. | |
| 2005/0079368 | A1 * | 4/2005 | Gorman | C23C 4/02 428/469 |
| 2006/0188736 | A1 * | 8/2006 | Luthra | C04B 41/009 428/469 |
| 2009/0087306 | A1 | 4/2009 | Tholen et al. | |
| 2009/0162632 | A1 * | 6/2009 | Kirby | C23C 30/00 428/304.4 |
| 2009/0226746 | A1 | 9/2009 | Chakrabarti et al. | |
| 2009/0291323 | A1 * | 11/2009 | Schlichting | C23C 4/02 428/698 |
| 2010/0158680 | A1 * | 6/2010 | Kirby | C04B 41/009 415/200 |
| 2010/0247298 | A1 | 9/2010 | Nakamura et al. | |
| 2011/0318549 | A1 * | 12/2011 | Schmidt | C04B 41/009 428/201 |
| 2012/0027572 | A1 | 2/2012 | Denece et al. | |
| 2012/0148794 | A1 | 6/2012 | Keller et al. | |
| 2012/0163985 | A1 | 6/2012 | Darkins, Jr. et al. | |

FOREIGN PATENT DOCUMENTS

| | | | |
|---|---|---|---|
| EP | 2045445 | A2 | 4/2009 |
| WO | 2010103213 | A1 | 9/2010 |

OTHER PUBLICATIONS

Response to Extended Search Report dated Nov. 10, 2015, and Communication dated Jan. 11, 2016 from counterpart European Application No. 15172924.1, filed May 20, 2016, 5 pp.

* cited by examiner

COATING FOR ISOLATING METALLIC COMPONENTS FROM COMPOSITE COMPONENTS

CROSS REFERENCE TO RELATED APPLICATIONS

This application claims priority to and the benefit of U.S. Provisional Patent Application No. 62/018,712, filed 30 Jun. 2014, the disclosure of which is now expressly incorporated herein by reference.

FIELD OF THE DISCLOSURE

The present disclosure relates generally to gas turbine engines, and more specifically to coatings used in gas turbine engine assemblies.

BACKGROUND

Gas turbine engine components are exposed to high temperature environments with an increasing demand for even higher temperatures. Economic and environmental concerns relating to the reduction of emissions and the increase of efficiency are driving the demand for higher gas turbine operating temperatures. In order to meet these demands, temperature capability of the components in hot sections such as blades, vanes, blade tracks, and combustor liners must be increased.

Ceramic matrix composites may be a candidate for inclusion in the hot sections where higher gas turbine engine operating temperatures are required. One benefit of ceramic matrix composite engine components is the high-temperature mechanical, physical, and chemical properties of the ceramic matrix composite components which allow the gas turbine engines to operate at higher temperatures than current engines.

To implement ceramic matrix composite components into gas turbine engines, the ceramic matrix composite components may be held in place by metallic structures. The metallic structures may interact chemically with the ceramic matrix composite at high temperatures when used over long durations. In some cases, the interaction of metallic structures and ceramic matrix composites supported thereon, may lead to degradation of the metallic structures.

SUMMARY

The present disclosure may comprise one or more of the following features and combinations thereof.

According to an aspect of the present disclosure, a method of isolating a metallic support component from a silicon-comprising composite component in a gas turbine engine may include applying a precursor coating onto the metallic support component, mounting the silicon-comprising composite component so that the silicon-comprising composite engages the precursor coating applied to the metallic support component to form an engine assembly, and operating the gas turbine engine comprising the engine assembly so that the precursor coating is heated to a predetermined temperature to form a dual layer barrier coating comprising an oxide layer along an exterior edge of a base layer from the precursor coating so that the silicon in the silicon-comprising composite component is restricted from ingress into the metallic support component by the oxide-comprising layer during further operation of the gas turbine engine.

In some embodiments the precursor coating may comprise an oxide selected from the group consisting of chromium oxide, aluminum oxide, and silicon oxide. The precursor coating may include a refractory metal that assists the formation of the oxide-comprising layer. In some embodiments the refractory metal included in the precursor coating may be selected from the group consisting of molybdenum, tungsten, and tantalum. In some embodiments the precursor coating may comprise between about 1 weight percent and about 60 weight percent of the refractory metal.

In some embodiments the oxide-comprising layer of the barrier coating may have a thickness of between about 0.5 microns and about 10 microns. The barrier coating may have a thickness of between about 25 microns and about 300 microns. In some embodiments the temperature that causes the formation of the oxide-comprising layer along an exterior edge of the base layer of the barrier coating is between about 1,500° F. and about 1,800° F.

According to another aspect of the present disclosure, a method of isolating a metallic support component from a silicon-comprising composite component in a gas turbine engine is taught. The method may comprise, applying a precursor coating onto a mating surface of a metallic support component, heat treating the precursor coating to a predetermined temperature to form an oxide-comprising layer along an exterior edge of the precursor coating to produce a dual-layer barrier coating, and engaging the silicon-comprising composite component with the barrier coating so that silicon included in the silicon-comprising component is restricted from diffusing into the metallic support component by the oxide-comprising layer.

In some embodiments the precursor coating may comprise an oxide selected from the group consisting of chromium oxide, aluminum oxide, and silicon oxide. The precursor coating may include a refractory metal that assists the formation of the oxide-comprising layer. In some embodiments the refractory metal included in the precursor coating may be selected from the group consisting of molybdenum, tungsten, and tantalum. In some embodiments the precursor coating may comprise between about 1 weight percent and about 60 weight percent of the refractory metal.

In some embodiments the oxide-comprising layer of the barrier coating may have a thickness of between about 0.5 microns and about 10 microns. The barrier coating may have a thickness of between about 25 microns and about 300 microns. In some embodiments the temperature that causes the formation of the oxide-comprising layer along an exterior edge of the base layer of the barrier coating may be between about 1,500° F. and about 1,800° F.

According to another aspect of the present disclosure an engine assembly for use in a gas turbine engine is taught. The engine assembly may include a metallic hanger, a silicon-comprising composite component mounted to the metallic hanger so that the hanger supports the ceramic matrix composite component, and a barrier coating on the metallic hanger so that the silicon-comprising component engages the barrier coating without contacting the metallic hanger, the barrier coating comprising an interior base layer and an exterior oxide-comprising layer that is engaged by the silicon-comprising composite component, the exterior oxide layer having a thickness of between about 0.5 microns and about 15 microns.

In some embodiments the barrier coating may comprise an oxide selected from the group consisting of chromium oxide, aluminum oxide, and silicon oxide. The barrier coating may comprise between about 1 weight percent and about 60 weight percent of a refractory metal to assist in formation of an exterior oxide-comprising layer upon heating the barrier coating to a predetermined temperature when the engine assembly is used in a gas turbine engine.

In some embodiments the hanger may include a radially-extending portion and an axially-extending portion that extends from the radially-extending portion. The barrier coating may be applied to the axially-extending portion, and the barrier coating may have a thickness that decreases as the axially-extending portion extends away from the radially-extending portion. In some embodiments the exterior oxide-comprising layer may be formed by a process comprising the steps of (i) assembling the metallic hanger and the silicon-comprising composite component into a gas turbine engine and (ii) heating a precursor coating applied to the metallic hanger at the interface of the metallic hanger with the silicon-comprising component to a predetermined temperature.

DETAILED DESCRIPTION OF THE DRAWINGS

Figures 1, 2:
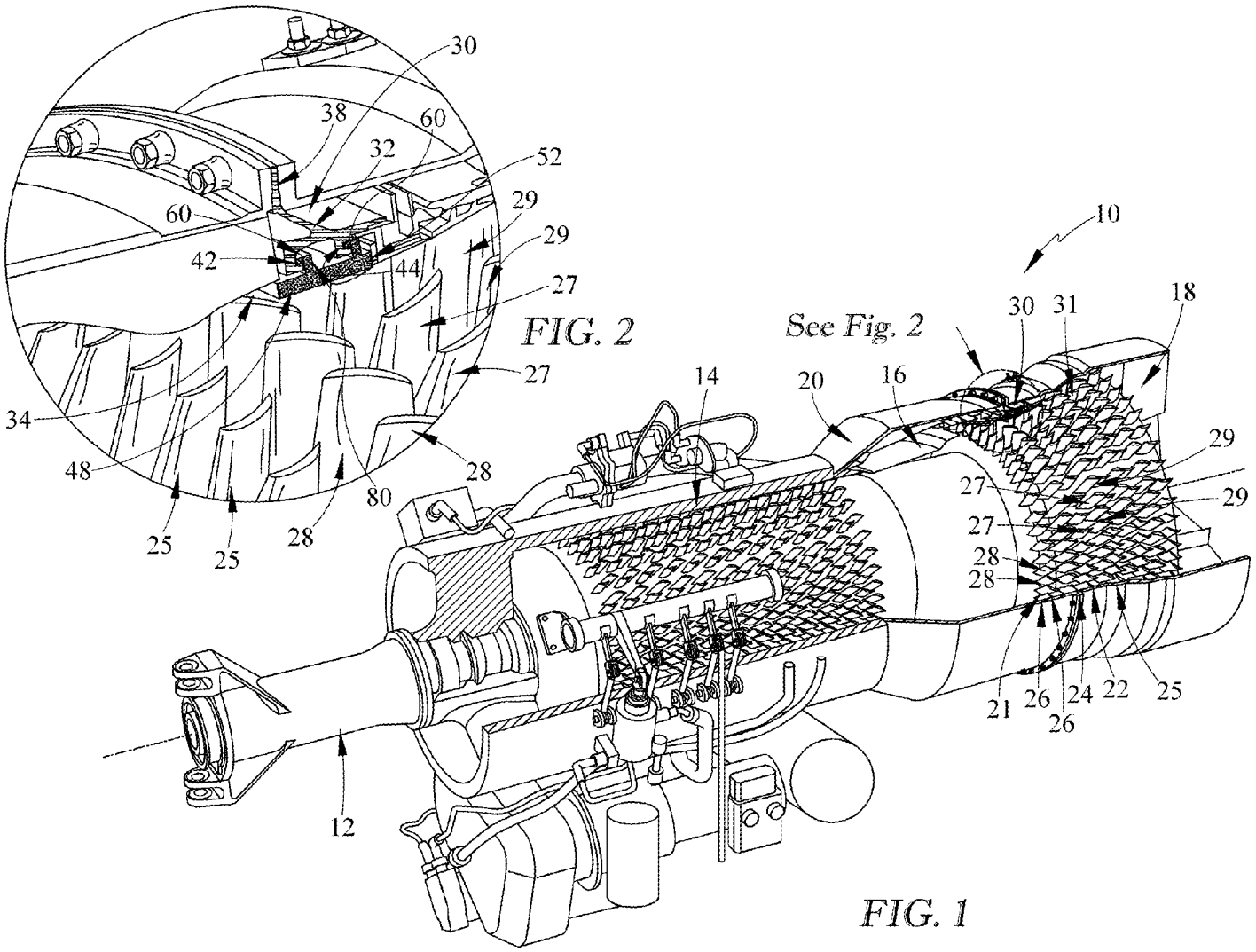
FIG. 1 is a cut-away perspective view of a gas turbine engine showing that the gas turbine engine includes a compressor section, a combustor section, and a turbine section that cooperate to drive an output shaft.
FIG. 2 is a detail view of a turbine shroud included in a turbine section of the gas turbine engine from FIG. 1 showing a ceramic blade track held in place by a metallic carrier and a barrier coating isolating the metallic carrier from the ceramic blade track as shown with more detail in FIG. 4.

For the purposes of promoting an understanding of the principles of the disclosure, reference will now be made to a number of illustrative embodiments illustrated in the drawings and specific language will be used to describe the same.

An illustrative aerospace gas turbine engine 10 may include an output shaft 12, a compressor section 14, a combustor section 16, and a turbine section 18 all mounted to a case 20 as shown in FIG. 1. The output shaft 12 may be coupled to a propeller (not shown) and may be driven by the turbine section 18. The compressor section 14 may compress and deliver air to the combustor section 16. The combustor section 16 may mix fuel with the compressed air received from the compressor section 14 to ignite the fuel. The hot high pressure products of the combustion reaction in the combustor section 16 may be directed into the turbine section 18 and the turbine section 18 may extract work to drive the compressor section 14 and the output shaft 12 as suggested in FIG. 1.

The turbine section 18 illustratively may include static turbine vane assemblies 21, 22 and corresponding turbine wheel assemblies 24, 25 as shown in FIG. 1. Each vane assembly 21, 22 may include a plurality of corresponding vanes 26, 27, etc. and each turbine wheel assembly 24, 25 may include a plurality of corresponding blades 28, 29. The vanes 26, 27 of the vane assemblies 21, 22 may extend across the flow path of the hot, high-pressure combustion products from the combustor 16 to direct the combustion products toward the blades 28, 29 of the turbine wheel assemblies 24, 25. The blades 28, 29 may in turn be pushed by the combustion products to cause the turbine wheel assemblies 26, 27 to rotate; thereby, driving the rotating components of the compressor section 14 and the output shaft 12.

Figure 3:
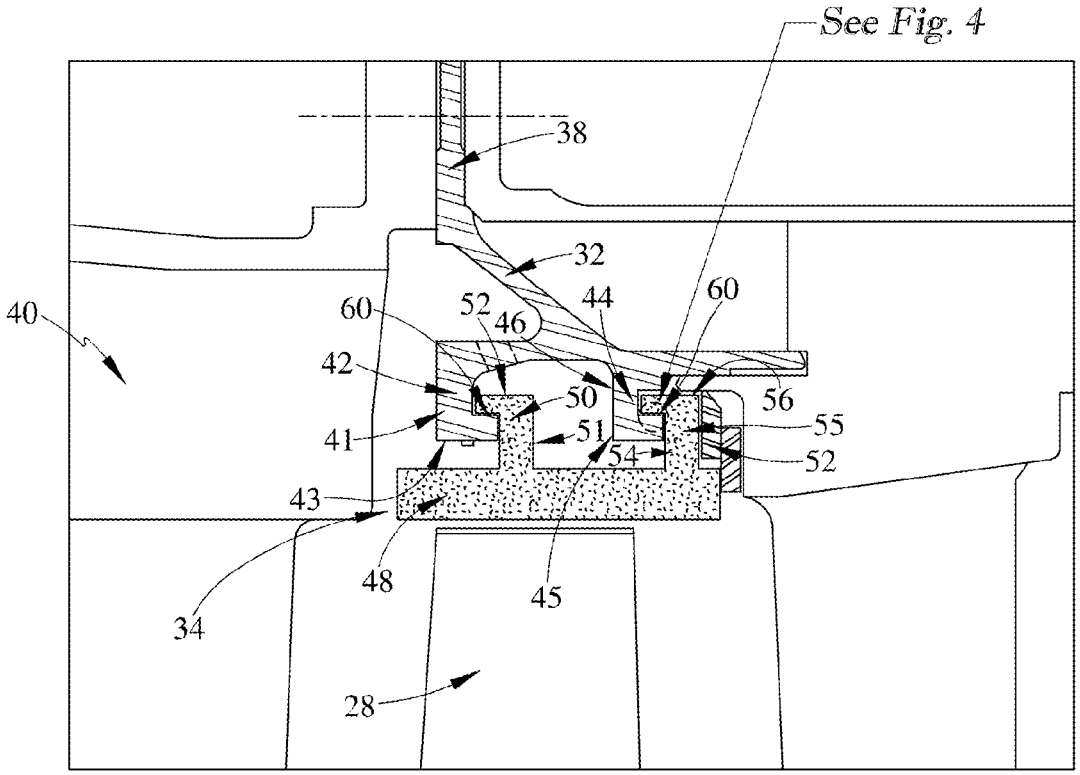
FIG. 3 is a cross-sectional view of the turbine shroud of FIG. 2 showing the ceramic blade track held in place by metallic hangers included in the metallic carrier.

The turbine section 18 also includes a plurality of turbine shrouds 30, 31 that extend around each turbine wheel assembly 24, 25 to block combustion products from passing over the blades 28, 29 without pushing the blades 28, 29 to rotate as suggested in FIG. 1. The turbine shroud 30 may include a carrier 32 and a blade track (sometimes called a seal ring) 34 as shown in FIGS. 2 and 3. The carrier 32 may be an annular, round, metallic component and may support the blade track 34 in position adjacent to the blades 28 of the turbine wheel assembly 24. The illustrative blade track 34 may be made from silicon-comprising ceramic matrix composite materials. The blade track 34 may include a retainer 52 that engages the carrier 32 to position the blade track 34 relative to other static turbine components in the gas turbine engine 10.

Figure 4:
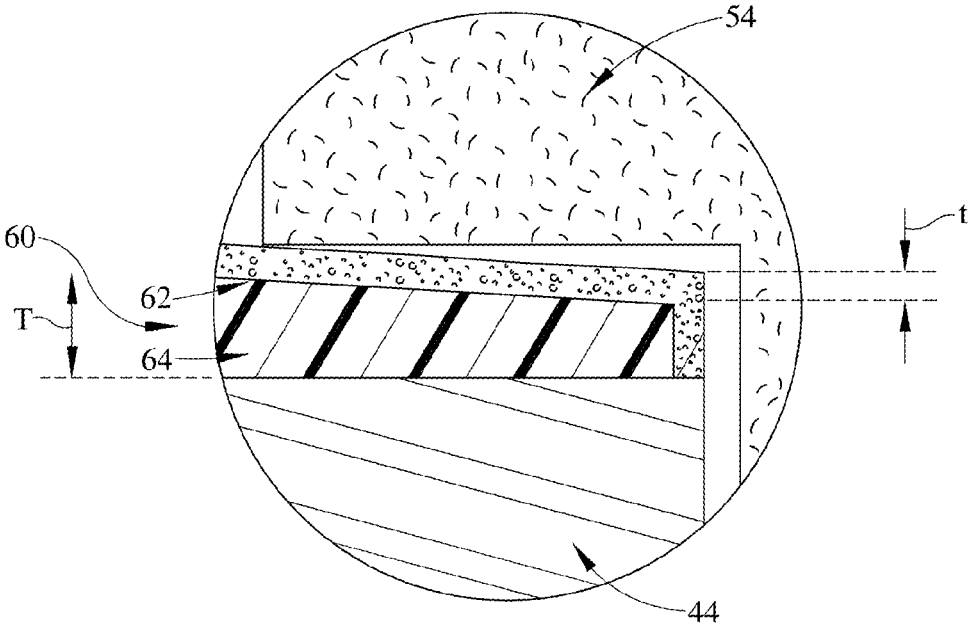
FIG. 4 is a detail view of a portion of FIG. 3 showing that the barrier coating, applied to the metallic carrier, separates the ceramic blade track from the metallic carrier and that the barrier coating includes an oxide layer formed along an exterior edge of a base layer of the barrier coating.

A barrier coating 60 may be adhered to the carrier 32 at interfaces of the carrier 32 with the blade track 34 as shown in FIGS. 3 and 4. As suggested, the barrier coating 60 may block the diffusion or ingress of silicon or other similar elements from the carrier 32 into the blade track 34. The barrier coating 60 may include an oxide layer 62 along the exterior edge or exterior surface of a base layer 64.

Figure 5:
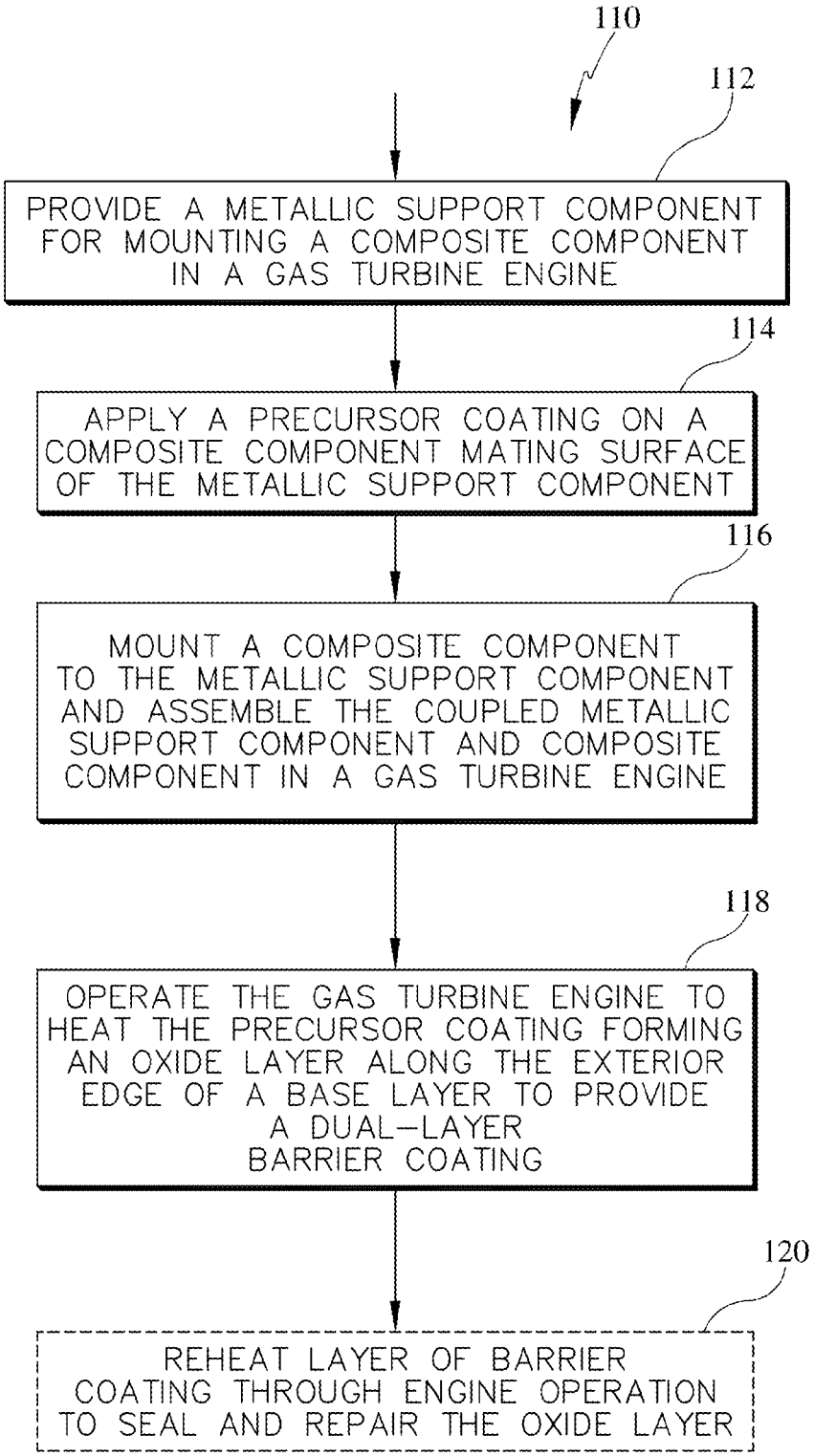
FIG. 5 is a block diagram showing a method for isolating a metallic support component, such as the metallic carrier of FIGS. 2-4, from a ceramic component, such as the blade track of FIGS. 2-4, in a gas turbine engine.

The precursor coating 63 may be heated to a predetermined temperature to cause formation of the oxide layer 62 along an exterior surface of the base layer 64 as suggested in FIG. 5 and illustratively show in FIGS. 6-10. The base layer 64 may be sandwiched between the oxide layer 62 and the metallic hanger 44 to create the dual-layer coating. The base layer 64 substantially may not include an oxidant and may not be further oxidized. The base layer is essentially the same as precursor coating. An area between the oxide layer 62 and the base layer 64 may not be substantially distinct and may include overlapping of the oxide layer 62 and the base layer 64. Once the oxide layer 62 is formed, the interface between the oxide layer 62 and the base layer 64 may be distinct.

In the illustrative embodiment, the precursor coating 63 may be heated during use of the turbine shroud 30 in the gas turbine engine 10 to cause formation of the oxide layer 62 exterior to the base layer 64 as shown in FIGS. 6-10. In other embodiments, heat treatment of the turbine shroud 30 in a furnace may be performed prior to use in the gas turbine engine 10 to cause formation of the oxide layer 62 exterior to the base layer 64. By creating the dual layers of the barrier coating 60 in situ, the thickness of the barrier coating 60 and the time to coat the metallic carrier 32 may be reduced.

The barrier coating 60 and/or the oxide layer 62 may include chromium oxide, aluminum oxide, and/or silicon oxide. A refractory metal such as molybdenum, tungsten, and/or tantalum may also be included in the barrier coating 60 to assist in the formation of the oxide layer 62 during a heating process.

The illustrative barrier coating 60 may have a thickness T of between about 25 microns and about 300 microns as depicted in FIG. 4. The oxide layer 62 of the barrier coating 60 may have a thickness t of between about 0.6 microns and about 10 microns as depicted in FIG. 4. The barrier coating 60 may have an axial thickness that decreases as the axially-extending portions 43, 45 extend away from the radially-extending portions 41, 46 of the forward and aft hangers 42, 44 as depicted in FIG. 4. Thus, the barrier coating 60 is thicker at the locations adjacent to the radially-extending portions 41, 46 than at locations spaced apart from the radially-extending portions 41, 46. This arrangement may reduce forces applied to the carrier 32 from the blade track 34.

The carrier 32 may include an attachment flange 38 coupled to the case 20, a forward hanger 42, and an aft hanger 44 as shown in FIGS. 2-4. The forward hanger 42 illustratively may have a radially-extending portion 41 and an axially-extending portion 43 for hanging the blade track 34. The aft hanger 44, like the forward hanger 42, illustratively may have a radially-extending portion 46 and an axially-extending portion 45 for hanging the blade track 34 as shown in FIGS. 3-4. The carrier 32 may be made from a metallic alloy such as nickel-based or cobalt-based alloy.

The blade track 34 may include a runner 48, a forward attachment arm 50 and an aft attachment arm 54 as shown in FIGS. 2-4. The runner 48 may extend around the turbine wheel assembly 24 to block gasses from passing over the turbine blades 28 without pushing the blades 28. The forward attachment arm 50 may have a radially-extending portion 51 and may have an axially-extending portion 52. The aft attachment arm 54 may have a radially-extending portion 55 and an axially-extending portion 56 for attaching to the carrier 32. The blade track 34 may include or be formed of a silicon-carbide/silicon-carbide ceramic matrix composite. The silicon-comprising blade track 34 may interact with the nickel or any number of constituent materials of the metallic carrier 32 Free Si from the composite diffuses into the metallic component and may react with nickel and other alloy elements, which may degrade performance of the component. Silicon in large quantities may alloy with the metallic carrier and may form phases having a lower melting point than the surrounding nickel-based material. The interaction may degrade the properties and performance of the carrier 32, if direct contact between the components is allowed. The barrier coating 60 may reduce silicon diffusion and other reactions allowing the carrier 32 to retain desired properties.

In the illustrative embodiment, the barrier coating 60 may be applied to the axially-extending portions 43, 45 of the forward and aft hangers 41, 46 as shown in FIG. 3. The barrier coating 60 on the axially-extending portions 43, 45, of the forward and aft hangers 41, 46 may mate with or engage with the blade track 34. While in the preceding example the barrier coating 60 is shown and described in conjunction with the turbine shroud 30, it may be incorporated at other interfaces throughout the gas turbine engine 10. More specifically, the barrier coating 60 may be used at the interface of any metallic component with a composite component to block chemical interaction between the metallic component and the composite component. In one example, metallic combustor supports may hold composite liner tiles in place and the barrier coating 60 may be applied at the interface between the metallic combustor supports and the composite liner tiles. In another example, metallic turbine rotors may hold composite turbine blades in place around turbine wheels and the barrier coating 60 may be applied at the interface between the metallic turbine rotors and the composite turbine blades.

One illustrative method 110 for isolating a metallic support component, such as the carrier 32, from a composite component, such as a blade track 34, is shown in FIG. 5. In a step 112 of the method 110, a metallic support component is provided for mounting a composite component in a gas turbine engine 10 as suggested in FIG. 5 shown illustratively with the metallic aft hanger 44 in FIG. 6.

Figure 7:
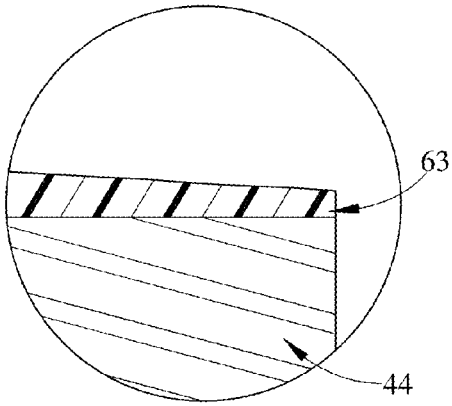
FIG. 7 is a detail view of the metallic support component, such as the metallic carrier of FIGS. 2-4 showing the precursor coating applied to the metallic support component.

In a step 114 of the method 110, a precursor coating 63 may be applied to the ceramic mating surface of a metallic component such as the aft hanger 44 of the carrier 32 as suggested in FIG. 5 and illustratively depicted in FIG. 7. Upon heating, the precursor coating 63 may be transformed into the dual-layer barrier coating 60 which may include a base layer 64 and an oxide layer 62. The precursor coating 63 may be applied as a single layer or a plurality of layers using electro-deposition, chemical vapor deposition, physical vapor deposition or any other suitable process as depicted in FIG. 7. The precursor coating 63 may include chromium, aluminum, silicon, cobalt, nickel and/or any other alloys. The precursor coating may be Co-based and may need Cr and/or Al to form chromium or aluminium on the coating surface. Nickel may be added for improved oxidation resistance, but silicon may easily diffuse into nickel. In some examples, the precursor coating 63 may include a refractory metal such as molybdenum, tungsten, and/or tantalum, which may act as a silicon getter. In a step 116 of the method 110, the composite component may be mounted to the metallic support component and assembled in a gas turbine engine so the precursor coating 63 is engaged as suggested in FIG. 5 and illustratively depicted in FIG. 8.

Figure 9:
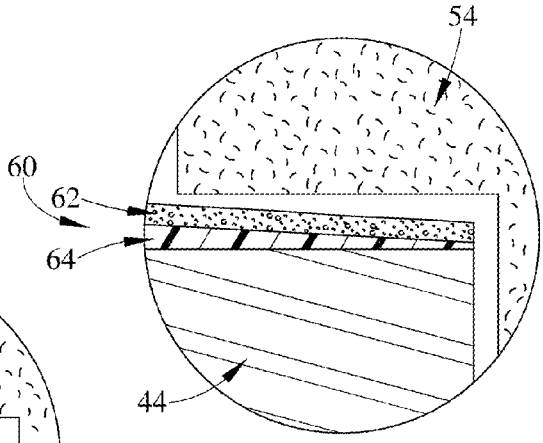
FIG. 9 is a detail view of the barrier coating formed after heating the precursor coating of FIG. 8 to separate the metallic support component from the ceramic component.

In a step 118 of the method 110, the gas turbine engine 10 may be operated to heat the precursor coating 63 forming an oxide layer 62 exterior to a base layer 64 within the barrier coating 60 as suggested in FIG. 5 and illustratively depicted in FIG. 9. Operating the gas turbine engine 10 to temperatures between about 1,500 degrees Fahrenheit and about 1,800 degrees Fahrenheit in an atmosphere that includes oxygen will cause the formation of the oxide layer on the exterior surface of the base layer In some embodiments (not shown) the precursor coating 63 may be heat treated to a predetermined temperature that may cause the formation of an oxide layer 62 exterior to the base layer 64 prior to mounting the composite component on the metallic support component in the gas turbine engine 10. The heating of the precursor coating 63 may allow for the formation of the oxide layer 62 on the exterior edge of the barrier coating 60 creating the dual layer coating wherein the base layer is sandwiched between the oxide layer 62 and the metallic aft hanger 44.

Figure 10:
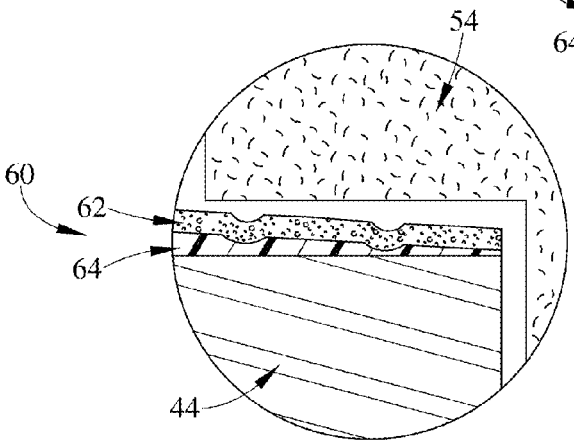
FIG. 10 is a detail view of the barrier coating after use in a gas turbine engine depicting small holes in the barrier coating which may be healed through further heating of the barrier coating.

In an optional step 120, the barrier coating 60 may be reheated through engine operation to seal and repair the coating. By operating the engine to temperatures between about 1,500° F. and about 1,800° F. the damaged portions of the oxide layer 62 may be sealed after normal use of the assembly as depicted in FIG. 10. For example, if the oxide layer 62 separates from the base layer 64, the base layer 64 that may be exposed from the loss of the oxide layer 62 may oxidize to form a further oxidized layer as depicted in FIG. 10. Alternatively, during normal maintenance of the parts another layer or a plurality of layers of precursor coating 63 may be added and heated to create the dual layer barrier coating 60 to repair any cracks in the barrier coating.

Heating the precursor coating 63 may occur during engine 10 operation and/or during a heat treatment applied before assembly in a gas turbine engine 10. The precursor coating 63 may include chromium, aluminum, silicate and/or other materials. The precursor coating 63 may also include a refractory metal that makes up between about 0.1 and about 60 weight percent and may assist in the formation of the exterior oxide comprising layer.

The following examples are illustrative of the invention and are not intended to limit the scope of the invention.

Example 1

Figure 6:
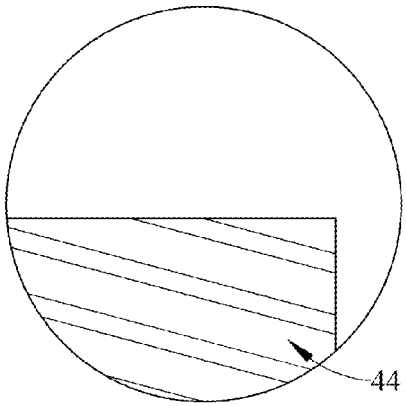
FIG. 6 is a detail view of the metallic support component, such as the metallic carrier of FIGS. 2-4.
Figure 11:
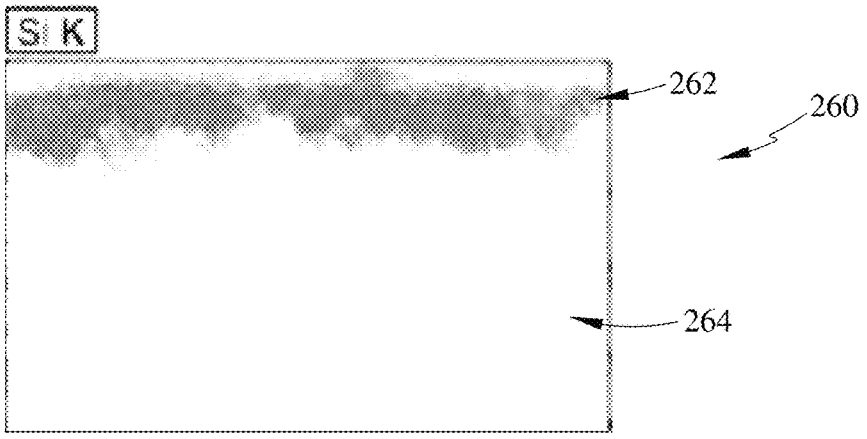
FIG. 11 is a micrograph of an illustrative barrier coating comprising an oxide layer formed along an exterior edge of a base layer by applying a Metco-68F-NS-1 precursor coating to a metallic support component and heating the precursor coating.

A precursor coating 63 of Metco 68F-NS-1 received from Sulzer-Metco (Co 28.5 MO 17.5 Cr 3.4 Si weight %) was heated to form a barrier coating 260 comprising a base layer 264, and an exterior oxide layer 262 as shown in the cross sectioning of the barrier coating 260 in FIG. 11. The precursor coating 63 may be applied to the forward hanger 42 and aft hanger 44 of the carrier 32 using thermal spray coating and/or air plasma spray. Heat treatment of the Metco 68F-NS-1 precursor coating 63 for 100 hours at 1600 degrees Fahrenheit, while in contact with a silicon-comprising composite component, resulted in no diffusion of silicon into the base layer 264 of the barrier coating 260 as shown in FIG. 6.

Example 2

Figure 12:
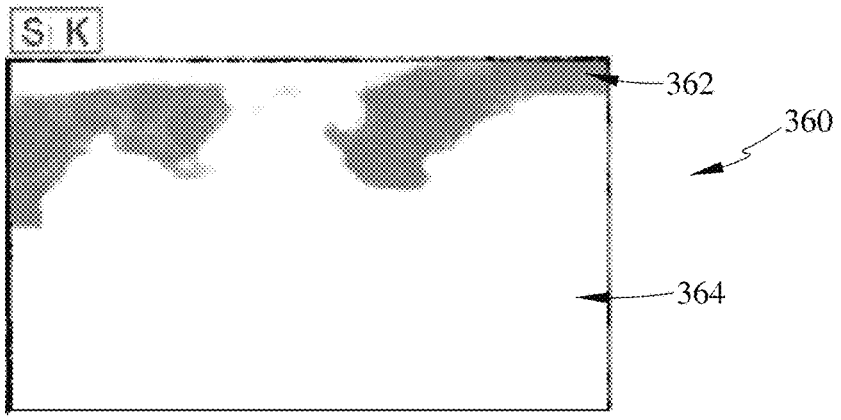
FIG. 12 is a micrograph of another illustrative barrier coating comprising an oxide layer formed along an exterior edge of a barrier layer by applying an Amdry 995C precursor coating to a metallic support component and heating the precursor coating.

A precursor coating 63 of Amdry 995C received from Sulzer-Metco (CO 32NI 21CR 8Al 0.5Y weight %) was heated to form a barrier coating 360 comprising a base layer 364 and an exterior oxide layer 362 as shown in the cross sectioning of the barrier coating 360 in FIG. 12. The precursor coating 63 may be applied to the forward hanger 42 and aft hanger 44 of the carrier 32 using thermal spray coating and/or air plasma spray. Heat treatment of the Amdry 995C precursor coating 63 for 100 hours at 1600 degrees Fahrenheit, while in contact with a silicon-comprising composite component, resulted in no diffusion of silicon into the base layer 364 of the barrier coating 360 as shown in FIG. 7.

Example 3

Figure 8:
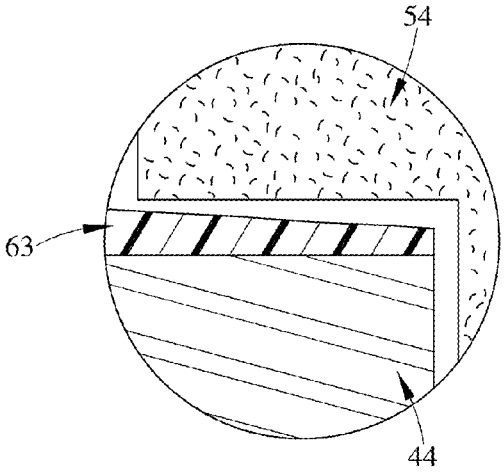
FIG. 8 is a detail view of the precursor coating sandwiched between the ceramic matrix component such as the blade track of FIGS. 2-4 and the metallic support component such as the metallic carrier of FIGS. 2-4.
Figure 13:
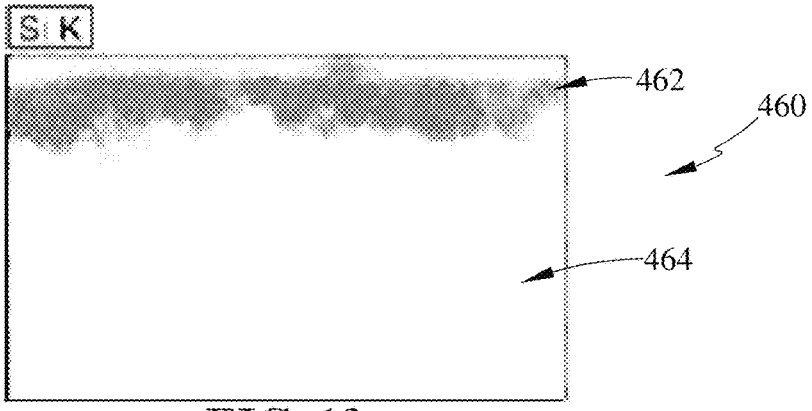
FIG. 13 is a micrograph of yet another illustrative barrier coating comprising an oxide layer formed along an exterior edge of a base layer by applying an Amdry 509 precursor coating to a metallic support component and heating the precursor coating.

In another example, a precursor coating 63 of Amdry MM509 received from Sulzer-Metco (Co 23.Cr 10 Ni 7W 3.5Ta 06.C weight %) was heated to form a barrier coating 460 comprising a base layer 464 and an exterior oxide layer 462 as shown in the cross sectioning of the barrier coating 460 in FIG. 13. The precursor coating 63 may be applied to the forward hanger 42 and aft hanger 44 of the carrier 32 using thermal spray coating and/or air plasma spray. Heat treatment of the Amdry MM509 precursor coating 63 for 100 hours at 1600 degrees Fahrenheit while in contact with a silicon-comprising composite component resulted in no diffusion of silicon into the base layer 464 of the barrier coating 460 as shown in FIG. 8.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A method of isolating a metallic support component from a silicon-comprising composite component in a gas turbine engine, the method comprising:

applying a precursor coating onto the metallic support component;

mounting the silicon-comprising composite component so that the silicon-comprising composite component engages the precursor coating applied to the metallic support component to form an engine assembly; and operating a gas turbine engine comprising the engine assembly so that the precursor coating is heated to a predetermined temperature to form a dual layer barrier coating comprising an oxide layer along an exterior edge of a base layer from the precursor coating so that silicon in the silicon-comprising composite component is restricted from ingress into the metallic support component by the oxide-comprising layer during further operation of the gas turbine engine.

2. The method of claim 1, wherein the oxide-comprising layer comprises an oxide selected from the group consisting of chromium oxide, aluminum oxide, silicon oxide, and combinations thereof.

3. The method of claim 2, wherein the precursor coating includes a base metal selected from the group consisting of nickel, cobalt, aluminum, and combinations thereof.

4. The method of claim 1, wherein the precursor coating includes a refractory metal selected from the group consisting of molybdenum, tungsten, tantalum, and combinations thereof.

5. The method of claim 4, wherein the precursor coating comprises between about 1 weight percent and about 60 weight percent of the refractory metal.

6. The method of claim 1, wherein the oxide-comprising layer of the barrier coating has a thickness of between about 0.5 microns and about 10 microns.

7. The method of claim 6, wherein the barrier coating has a thickness of between about 25 microns and about 300 microns.

8. The method of claim 1, wherein the predetermined temperature that causes the formation of the oxide-comprising layer along an exterior edge of the base layer of the barrier coating is between about 1,500° F. and about 1,800° F.

9. A method of isolating a metallic support component from a silicon-comprising composite component in a gas turbine engine, the method comprising applying a precursor coating onto a mating surface of a metallic support component, wherein the precursor coating includes a refractory metal;

heat treating the precursor coating to a predetermined temperature to form an oxide-comprising layer along an exterior edge of the precursor coating to produce a dual-layer barrier coating, wherein the refractory metal assists the formation of the oxide-comprising layer; and engaging the silicon-comprising composite component with the barrier coating so that silicon included in the silicon-comprising composite component is restricted from diffusing into the metallic support component by the oxide-comprising layer.

10. The method of claim 9, wherein the precursor coating comprises an oxide selected from the group consisting of chromium oxide, aluminum oxide, silicon oxide, and combinations thereof.

11. The method of claim 9, wherein the barrier coating defines a thickness of between about 25 microns and about 300 microns.

12. The method of claim 9, wherein the refractory metal included in the precursor coating is selected from the group consisting of molybdenum, tungsten, tantalum, and combinations thereof.

13. The method of claim 9, wherein the precursor coating comprises between about 1 weight percent and about 60 weight percent of the refractory metal.

14. The method of claim 9, wherein the oxide-comprising layer of the barrier coating has a thickness of between about 0.5 microns and about 15 microns.

15. The method of claim 9, wherein the predetermined temperature that causes the formation of the oxide-comprising layer along the exterior portion of the barrier coating is between about 1,500° F. and about 1,800° F.

16. An engine assembly for a gas turbine engine, the assembly comprising a metallic hanger, a silicon-comprising composite component mounted to the metallic hanger so that the hanger supports the ceramic matrix composite component, and a barrier coating on the metallic hanger so that the silicon-comprising composite component engages the barrier coating without contacting the metallic hanger, the barrier coating comprising an interior base layer and an exterior oxide-comprising layer that is engaged by the silicon-comprising composite component, the exterior oxide-comprising layer having a thickness of between about 0.5 microns and about 15 microns, wherein the barrier coating comprises between about 1 weight percent and about 60 weight percent of a refractory metal that assists the formation of the oxide-comprising layer upon heating the barrier coating to a predetermined temperature.

17. The engine assembly of claim 16, wherein the barrier coating comprises an oxide selected from the group consisting of chromium oxide, aluminum oxide, silicon oxide, and combinations thereof.

18. The engine assembly of claim 16, wherein the barrier coating defines a thickness of between about 25 microns and about 300 microns.

19. The engine assembly of claim 16, wherein the hanger includes a radially-extending portion and an axially-extending portion that extends from the radially-extending portion, the barrier coating is applied to the axially-extending portion, and the barrier coating has an axial thickness that decreases as the axially-extending portion extends away from the radially-extending portion.

20. The engine assembly of claim 16, wherein the exterior oxide-comprising layer is formed by a process comprising the steps of (i) assembling the metallic hanger and the silicon-comprising composite component into a gas turbine engine and (ii) heating a precursor coating applied to the metallic hanger at the interface of the metallic hanger with the silicon-comprising component to a predetermined temperature.

* * * * *